US012123067B2

(12) United States Patent
Jung et al.

(10) Patent No.: US 12,123,067 B2
(45) Date of Patent: Oct. 22, 2024

(54) FERRITIC STAINLESS STEEL HAVING IMPROVED PIPE-EXPANDING WORKABILITY AND METHOD FOR MANUFACTURING SAME

(71) Applicant: POSCO, Pohang-si (KR)

(72) Inventors: Il Chan Jung, Pohang-si (KR); Young Min Seo, Pohang-si (KR); Deok Chan Ahn, Seoul (KR)

(73) Assignee: POSCO CO., LTD, Pohang-si (KR)

( * ) Notice: Subject to any disclaimer, the term of this patent is extended or adjusted under 35 U.S.C. 154(b) by 430 days.

(21) Appl. No.: 16/767,206

(22) PCT Filed: Oct. 5, 2018

(86) PCT No.: PCT/KR2018/011764
§ 371 (c)(1),
(2) Date: May 27, 2020

(87) PCT Pub. No.: WO2019/124690
PCT Pub. Date: Jun. 27, 2019

(65) Prior Publication Data

US 2020/0385837 A1 Dec. 10, 2020

(30) Foreign Application Priority Data

Dec. 20, 2017 (KR) ..... 10-2017-0176335

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/004* (2013.01); *C21D 8/0205* (2013.01);
(Continued)

(58) Field of Classification Search
CPC ..... C21D 9/46; C21D 6/004; C21D 8/0205; C21D 8/0226; C21D 8/0236; C21D 2211/005; C22C 38/002; C22C 38/06
See application file for complete search history.

(56) References Cited

U.S. PATENT DOCUMENTS

2002/0012602 A1 1/2002 Takahashi et al.
2013/0008573 A1* 1/2013 Hamada ..... C22C 38/32 148/609
(Continued)

FOREIGN PATENT DOCUMENTS

EP 3095888 A1 * 11/2016 ..... C22C 38/00
JP 53048018 A 5/1978
(Continued)

OTHER PUBLICATIONS

Chinese Office Action dated Mar. 19, 2021 issued in Chinese Patent Application No. 201880081864.7 (with English.
(Continued)

*Primary Examiner* — Nicholas A Wang
*Assistant Examiner* — Maxwell Xavier Duffy
(74) *Attorney, Agent, or Firm* — Morgan, Lewis & Bockius LLP

(57) ABSTRACT

A ferritic stainless steel with improved expandability includes, in percent (%) by weight of the entire composition, Cr: 10 to 25%, N: 0.015% or less (excluding 0), Al: 0.005 t 0.04%, Nb: 0.1 to 0.6%, Ti: 0.1 to 0.5%, the remainder of iron (Fe) and other inevitable impurities, and satisfies the following equation (1):

$$Z=X*Y\geq 17 \quad \text{equation(1).}$$

5 Claims, 4 Drawing Sheets

(51) Int. Cl.

| | |
|---|---|
| ***C21D 8/02*** | (2006.01) |
| ***C22C 38/00*** | (2006.01) |
| ***C22C 38/06*** | (2006.01) |
| ***C22C 38/48*** | (2006.01) |
| ***C22C 38/50*** | (2006.01) |

(52) U.S. Cl.

CPC ..... *C21D 8/0226* (2013.01); *C21D 8/0236* (2013.01); *C21D 8/0247* (2013.01); *C22C 38/001* (2013.01); *C22C 38/002* (2013.01); *C22C 38/06* (2013.01); *C22C 38/48* (2013.01); *C22C 38/50* (2013.01); *C21D 2211/005* (2013.01)

(56) References Cited

U.S. PATENT DOCUMENTS

| | | | |
|---|---|---|---|
| 2015/0020933 A1 | 1/2015 | Tamada et al. | |
| 2018/0016655 A1* | 1/2018 | Hiraide ..... | C22C 38/28 |

FOREIGN PATENT DOCUMENTS

| | | | |
|---|---|---|---|
| JP | H04-311518 A | | 11/1992 |
| JP | H09-263900 A | | 10/1997 |
| JP | H11-323502 A | | 11/1999 |
| JP | 2001-294991 A | | 10/2001 |
| JP | 2002-194505 A | | 7/2002 |
| JP | 2003-213376 A | | 7/2003 |
| JP | 2005-194572 A | | 7/2005 |
| JP | 2005256124 A | * | 9/2005 |
| JP | 2016-156072 A | | 9/2016 |
| KR | 10-2014-0080351 A | | 6/2014 |
| KR | 2015-0110762 A | | 10/2015 |

OTHER PUBLICATIONS

Korean Office Action dated Feb. 20, 2019 issued in Korean Application No. 10-2017-0176335.

Korean Office Action dated Jul. 3, 2019 issued in Korean Application No. 10-2017-0176335.

Indian Office Action dated Oct. 5, 2021 issued in Indian Patent Application No. 202017025211 (with English translation).

Japanese Office Action dated Jul. 6, 2021 issued in Japanese Patent Application No. 2020-532695 (with English translation).

Written Opinion and International Search Report dated Jan. 30, 2019 issued in International Patent Application No. PCT/KR2018/011764 (English translation).

Extended European Search Report dated Jul. 20, 2020 issued in European Patent Application No. 18891502.9.

JIS Handbook Steel I, Japan Standards Association, Jan. 31, 2001.

Japanese Office Action dated Feb. 28, 2022, issued in corresponding Japanese Patent Application No. 2020-532695 (with English Translation).

* cited by examiner

【FIGURE 1】
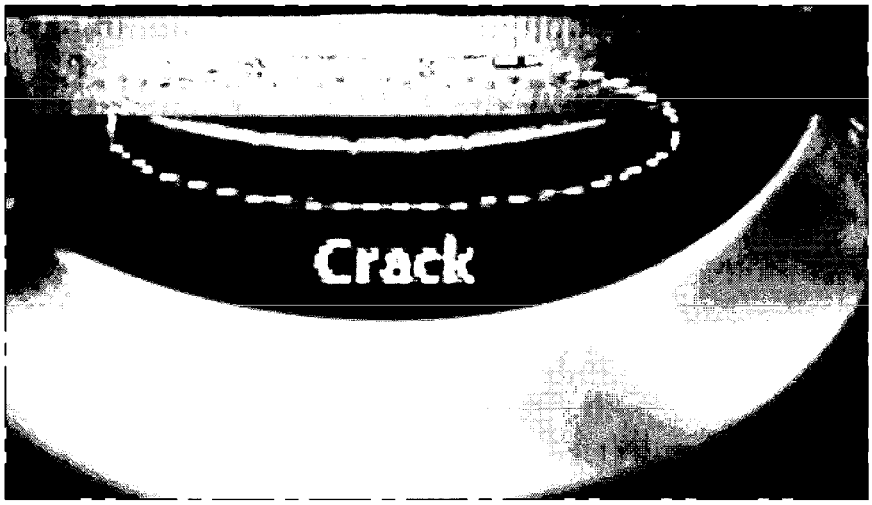

【FIGURE 2】
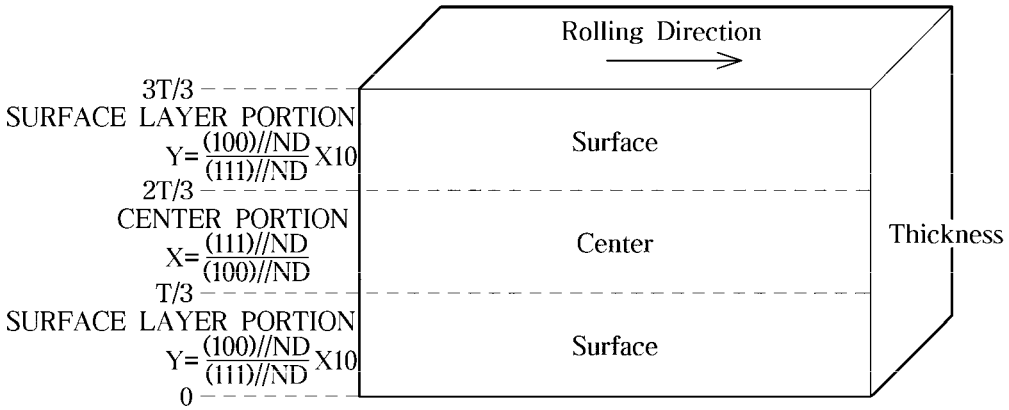

【FIGURE 3】
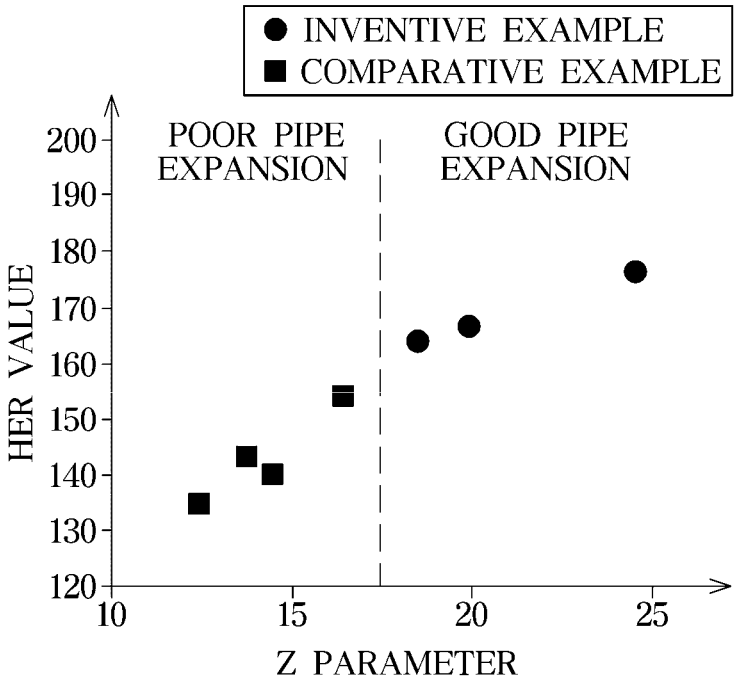

【FIGURE 4】
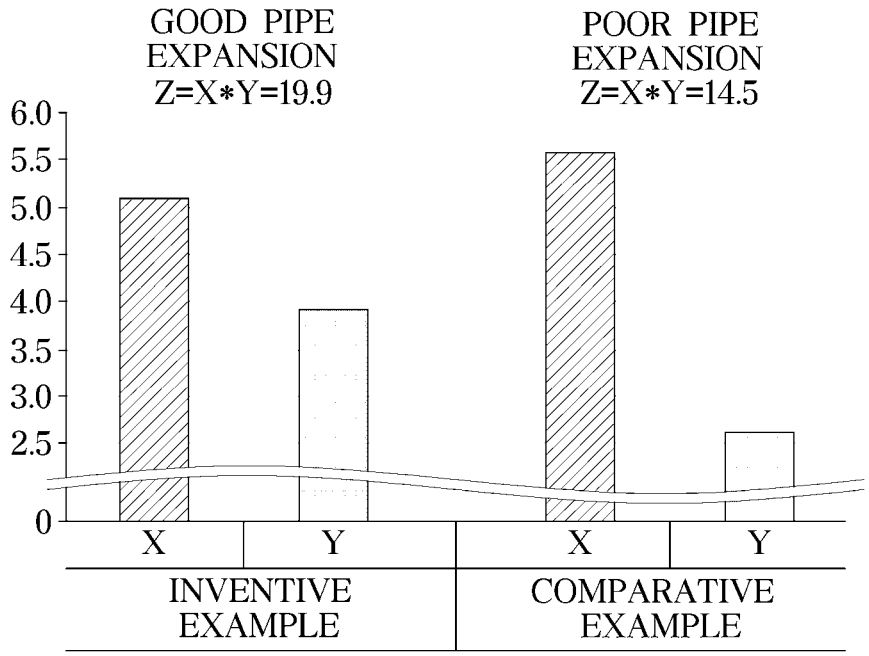

FERRITIC STAINLESS STEEL HAVING IMPROVED PIPE-EXPANDING WORKABILITY AND METHOD FOR MANUFACTURING SAME

CROSS-REFERENCE OF RELATED APPLICATIONS

This application is the U.S. National Phase under 35 U.S.C. § 371 of International Patent Application No. PCT/KR2018/011764, filed on Oct. 5, 2018, which in turn claims the benefit of Korean Application No. 10-2017-0176335, filed on Dec. 20, 2017, the entire disclosures of which applications are incorporated by reference herein.

TECHNICAL FIELD

The present disclosure relates to a ferritic stainless steel with improved expandability, and more particularly, to a ferritic stainless steel for automotive exhaust system with improved expandability by controlling texture conditions for each thickness position of a cold rolled annealing material.

BACKGROUND ART

Among stainless steel, ferritic stainless cold rolled products have excellent high temperature properties such as thermal expansion coefficient and thermal fatigue properties, and are resistant to stress corrosion cracking. Accordingly, ferritic stainless steel is widely used in automotive exhaust system parts, household appliances, structures, home appliances, elevators, and the like.

In general, the automotive exhaust system member is divided into a hot part and a cold part according to the temperature of the exhaust gas. Automotive parts for hot part include manifolds, converters and bellows, and the operating temperature of these parts is mainly 600° C. or higher, and it should be excellent in high temperature strength, high temperature thermal fatigue, and high temperature salt corrosion. On the other hand, the cold part has a use temperature of 400° C. or less, mainly a member such as a muffler that reduces noise of automobile exhaust gas corresponds to this.

The automotive exhaust system material mainly uses stainless steel that is highly resistant to external corrosion and internal condensate corrosion, and ferritic stainless steel without Ni is widely used rather than austenitic stainless steel containing Ni because of cost reduction. For example, there are materials such as stainless steel (or STS) 409, 409 L, 439, 436 L or Al plated stainless 409.

Recently, the trend of automotive exhaust system parts is that the shape of each part is becoming very complicated to increase the space efficiency of the lower part of the car as the number of parts of the exhaust system of the lower part of the car increases.

In the related art, with regard to deep drawing or pipe bending workability, there has been an approach to an overall thickness average texture viewpoint and an R value (Plastic-strain ratio) viewpoint, but a technical method for improving expandability has not yet been clearly established.

In the present disclosure, the surface layer portion and the center portion in the thickness direction for increasing expandability are classified, and the conditions of each texture and a range of components to satisfy the conditions are clearly presented.

DISCLOSURE

Technical Problem

The embodiments of the present disclosure are to provide a ferritic stainless steel for automotive exhaust system with improved expandability by controlling the size, distribution density, and rolling process conditions of inclusions to satisfy the texture conditions and target texture conditions for each thickness position of the steel, and a manufacturing method thereof.

Technical Solution

In accordance with an aspect of the present disclosure, a ferritic stainless steel with improved expandability includes, in percent (%) by weight of the entire composition, Cr: 10 to 25%, N: 0.015% or less (excluding 0), Al: 0.005 to 0.04%, Nb: 0.1 to 0.6%, Ti: 0.1 to 0.5%, the remainder of iron (Fe) and other inevitable impurities, and satisfies the following equation (1)

$$Z=X*Y\geq 17 \quad \text{equation (1)}$$

Here, based on the thickness T of ferritic stainless steel, X means [(111)//ND texture fraction]/[(100)//ND texture fraction] of the region from T/3 to 2T/3, and Y means 10*[(100)//ND texture fraction]/[(111)//ND texture fraction] of the region from the surface layer to T/3

The ferritic stainless steel may include Al—Ca—Ti—Mg—O oxide having a maximum diameter of 0.05 to 5 μm and a distribution density of 9/mm$^2$ or more.

The ferritic stainless steel may further include Ca: 0.0004 to 0.002%, Mg: 0.0002 to 0.001%.

The ferritic stainless steel may satisfy the following equation (2).

$$(D_f-D_0)/D_0*100\geq 160 \quad \text{equation (2)}$$

Here, $D_f$ means the hole length of the machining portion after molding, and $D_0$ means the length of the initial machining hole.

The thickness of the ferritic stainless steel may be 0.5 to 3 mm.

In accordance with an aspect of the present disclosure, a manufacturing method of a ferritic stainless steel with improved expandability includes hot rolling the slab comprising, in percent (%) by weight of the entire composition, Cr: 10 to 25%, N: 0.015% or less (excluding 0), Al: 0.005 to 0.04%, Nb: 0.1 to 0.6%, Ti: 0.1 to 0.5%, the remainder of iron (Fe) and other inevitable impurities; cold rolling the hot rolled material; and cold rolling annealing the cold rolled material, and the cold rolled annealing material satisfies the following equation (1)

$$Z=X*Y\geq 17 \quad \text{equation (1)}$$

Here, based on the thickness T of ferritic stainless steel, X means [(111)//ND texture fraction]/[(100)//ND texture fraction] of the region from T/3 to 2T/3, and Y means 10*[(100)//ND texture fraction]/[(111)//ND texture fraction] of the region from the surface layer to T/3.

The cold rolled annealing material may include Al—Ca—Ti—Mg—O oxide having a maximum diameter of 0.05 to 5 μm and a distribution density of 9/mm$^2$ or more.

The roll diameter of the cold rolling may be 100 mm or less.

Advantageous Effects

In the ferritic stainless steel according to the disclosed embodiment, a sandwich effect is developed due to texture development of different configurations of the center portion and the surface layer portion, so that the HER value increases and crack generation during pipe expanding can be suppressed.

DESCRIPTION OF DRAWINGS

FIG. 1 is a picture of parts for automotive exhaust system to which pipe expanding is applied and cracks generated during pipe expanding.

FIG. 2 is a cross-sectional view for describing a texture parameter according to an embodiment of the present disclosure.

FIG. 3 is a graph showing a correlation between a texture parameter and HER according to an embodiment of present disclosure.

FIG. 4 is a graph showing the X and Y values of an example and a comparative example of present disclosure.

BEST MODE

A ferritic stainless steel with improved expandability according to an embodiment of the present disclosure includes, in percent (%) by weight of the entire composition, Cr: 10 to 25%, N: 0.015% or less (excluding 0), Al: 0.005 to 0.04%, Nb: 0.1 to 0.6%, Ti: 0.1 to 0.5%, the remainder of iron (Fe) and other inevitable impurities, and satisfies the following equation (1)

$$Z=X*Y\geq 17 \quad \text{equation (1)}$$

Here, based on the thickness T of ferritic stainless steel, X means [(111)//ND texture fraction]/[(100)//ND texture fraction] of the region from T/3 to 2T/3, and Y means 10*[(100)//ND texture fraction]/[(111)//ND texture fraction] of the region from the surface layer to T/3.

Modes of the Invention

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may be not shown in order to clarify the present disclosure, and also, for easy understanding, the sizes of components are more or less exaggeratedly shown.

Also, when a part "includes" or "comprises" an element, unless there is a particular description contrary thereto, the part may further include other elements, not excluding the other elements.

An expression used in the singular encompasses the expression of the plural, unless it has a clearly different meaning in the context.

Hereinafter, embodiments according to the present disclosure will be described in detail with reference to the accompanying drawings. First, ferritic stainless steel is described, and then a manufacturing method of a ferritic stainless steel is described.

Inventors of the present disclosure were able to obtain the following findings as a result of various studies to improve expandability when ferritic stainless steel was used for exhaust system heat exchangers.

An array having a constant surface and orientation generated inside a crystal is called a texture. The pattern in which these textures develop in a certain direction is called texture fiber. The texture showing the aggregation of crystals has a close relationship with expandability. Among them, the texture group of the orientation generated in a direction perpendicular to the (111) plane of the textures is called gamma (γ)-fiber, and the texture group of the orientation generated in a direction perpendicular to the (100) plane is called a cube-fiber.

Gamma-fiber is mainly developed in the center portion of ferritic stainless steel, and cube-fiber is developed in the surface layer portion. It is known that the higher the fraction of gamma-fiber among these textures, the better the overall workability. Therefore, in conventional ferritic stainless steel, the gamma-fiber was increased and the cube-fiber was reduced.

On the other hand, when the pipe expanding of the hole, plane deformation occurs in the center portion, and only the (111)//ND texture needs to be strongly developed. However, in the surface layer portion around the hole, not only simple plane deformation, but also complicated deformation behavior in three axes occurs. In this case, since only (111)//ND texture is developed, cracks are generated as shown in FIG. 1, and thus there is a problem in that workability for various deformation behaviors cannot be secured. Accordingly, research on texture orientation that can secure a certain level of expandability is required.

In the present disclosure, as a result of studying texture orientation to improve expandability in ferritic stainless steel, it was found that workability can be secured under different deformation behavior conditions besides plane deformation by developing (100)//ND texture in the surface layer portion. Particularly, it has been found that the hole expandability can be improved by strongly developing the cube-fiber in the surface layer portion and the gamma-fiber in the center portion, thereby deriving texture parameters for each thickness position.

In order to develop different characteristics of the texture of the surface layer portion and the center portion in the thickness direction, it can be achieved by securing the roll diameter of 100 mm or less during cold rolling together with the alloy component, inclusion size and distribution density.

Hereinafter, ferritic stainless steel that exhibits excellent expandability by controlling the alloy element component and the texture by thickness position will be described even without the additional heat treatment process.

A ferritic stainless steel with improved expandability according to one aspect of the present disclosure includes, in percent (%) by weight, Cr: 10 to 25%, N: 0.015% or less, Al: 0.005 to 0.04%, Nb: 0.1 to 0.6%, Ti: 0.1 to 0.5%, the remainder of iron (Fe) and other inevitable impurities.

Hereinafter, the reason for the numerical limitation of the alloy component content in the embodiment of the present disclosure will be described. In the following, unless otherwise specified, the unit is % by weight.

The content of Cr is 10 to 25%.

Chromium (Cr) is the most contained element of the corrosion resistance improving element of stainless steel, and it is preferable to add 10% or more to express corrosion resistance. However, if the content is excessive, there is a possibility that intergranular corrosion may occur in ferritic stainless steel containing carbon and nitrogen, and there is a problem that manufacturing cost increases, and the upper limit may be limited to 25%.

The content of N is 0.015% or less.

Nitrogen (N) is an interstitial element, and when its content is excessive, the strength is excessively increased and the ductility is lowered, and the upper limit may be limited to 0.015%.

The content of Al is 0.005 to 0.05%.

Aluminum (Al) is an element added as a deoxidizing agent during steelmaking, and it is preferable to add 0.005% or more because it can lower the content of oxygen in molten steel. However, if the content is excessive, it may exist as a non-metallic inclusion, causing sliver defects in the cold rolled strip, and there is a problem in that weldability is deteriorated, and the upper limit can be limited to 0.05%.

The content of Nb is 0.1 to 0.6%.

Niobium (Nb) is an element that combines with solid solution C to precipitate NbC, and it is preferable to add 0.1% or more since it can improve the corrosion resistance and high temperature strength by lowering the solid solution C content. However, when the content is excessive, there is a problem that moldability is reduced by suppressing recrystallization, and the upper limit may be limited to 0.6%.

The content of Ti is 0.1 to 0.5%.

Titanium (Ti) is an element that fixes carbon and nitrogen, and it is preferable to add 0.1% or more since it can improve corrosion resistance of steel by lowering the content of solid solution C and solid solution N by forming a precipitate. However, if the content is excessive, there is a possibility that surface defects may occur due to coarse Ti inclusions, and there is a problem in that manufacturing costs increase, and the upper limit may be limited to 0.5%.

In addition, ferritic stainless steel with improved expandability according to an embodiment of the present disclosure, may further include Ca: 0.0004-0.002% and Mg: 0.0002~0.001%.

The content of Ca is 0.0004 to 0.002%.

Ca is an element input for deoxidation in the steelmaking process and remains as an impurity after the deoxidation process. However, if the content is excessive, corrosion resistance is inferior. Therefore, the content is limited to 0.002% or less, and since it is impossible to completely remove it, it is desirable to manage it to 0.0004% or more.

The content of Mg is 0.0002 to 0.001%.

Mg is an element added for deoxidation in the steelmaking process and remains as an impurity after the deoxidation process. However, if the content is excessive, the moldability is inferior. Therefore, the content is limited to 0.001% or less, and since it is impossible to completely remove it, it is preferable to manage it to 0.0002% or more.

The remaining component of the present disclosure is iron (Fe). However, in the normal manufacturing process, impurities that are not intended from the raw material or the surrounding environment can be inevitably mixed, and therefore cannot be excluded. Since these impurities are known to anyone skilled in the ordinary manufacturing process, they are not specifically mentioned in this specification.

FIG. 2 is a cross-sectional view for describing a texture parameter according to an embodiment of the present disclosure.

According to an embodiment of the present disclosure, ferritic stainless steel with improved expandability that satisfies the above-described alloy composition may satisfy equation (1) below.

$$Z=X*Y\geq 17 \quad \text{equation (1)}$$

Here, based on the thickness T of ferritic stainless steel, X means [(111)//ND texture fraction]/[(100)//ND texture fraction] of the region from T/3 to 2T/3, and Y means 10*[(100)//ND texture fraction]/[(111)//ND texture fraction] of the region from the surface layer to T/3.

As described above, it was confirmed that expandability under the deformation behavior conditions can be improved by increasing a fraction of crystal grains having a cube-fiber texture while suppressing gamma-fiber texture as much as possible on the surface layer portion and by increasing a fraction of crystal grains having a gamma-fiber texture while suppressing the cube-fiber texture as much as possible in the center portion.

The Z value is a parameter derived considering the thickness position and the texture fraction of other properties, and 10 in Y is a weight considering that cube fibers are less developed than gamma fibers.

At this time, the (111)//ND texture fraction in the center portion of the cold-rolled annealed ferritic stainless steel sheet may be 70% or less, and the (100)//ND texture fraction may be 2% or more. Further, in the surface layer portion, the (100)//ND texture fraction may be 30% or less, and the (111)//ND texture fraction may be 10% or more. Accordingly, X can satisfy a range of 35 or less and Y can satisfy a range of 30 or less.

According to an embodiment of the present disclosure, ferritic stainless steel with improved expandability that satisfies the aforementioned alloy composition may satisfy equation (2) below.

$$(D_f-D_0)/D_0*100\geq 160 \quad \text{equation (2)}$$

Here, $D_f$ means the hole length of the machining portion after molding, and $D_0$ means the length of the initial machining hole.

FIG. 3 is a graph showing a correlation between a texture parameter Z and Hole Expansion Ratio (HER).

A hole expandability is a material property of how expandable a hole processed through various processing methods on a steel sheet is without defects such as cracks or necking. Hole expandability is defined as (hole length of machining portion after molding)−(length of initial machining hole)*100/(length of initial machining hole).

When equation (1) is satisfied, the HER value is increased due to the similar cladding (sandwich) effect due to the formation of different textures of the surface layer portion and the center portion, and crack generation can be suppressed when expanding the actual part.

Referring to FIG. 3, a ferritic stainless steel with improved expandability according to an embodiment of the present disclosure has Z value of 17 or more.

Accordingly, the ferritic stainless steel according to an embodiment of the present disclosure may have a HER value of 160 or more. As the size of the HER increases, the pipe expanding becomes easy, and the larger the value, the more advantageous.

According to an embodiment of the present disclosure, as a method for realizing the recrystallized texture characteristics of the surface layer portion and the center portion differently, when developing from a deformed texture to a recrystallized texture, it includes an Al—Ca—Ti—Mg—O-based oxide that suppresses randomization of the texture so that the recrystallized texture is bound to the developed deformed texture before annealing. In addition, it was confirmed that the size and distribution density of these oxides should be secured to suppress the randomization of the texture of the weld zone.

For example, the Al—Ca—Ti—Mg—O-based oxide may include $TiO_2$, CaO, $Al_2O_3$, MgO, and the like.

In the present disclosure, the Al—Ca—Ti—Mg—O-based oxide having a maximum diameter of 0.05 to 5 μm may be defined as an effective oxide, and when such an effective oxide has a distribution density of 9/mm$^2$ or more, it can effectively act to improve expandability.

When the maximum diameter of the Al—Ca—Ti—Mg—O-based oxide is less than 0.05 μm, the oxide is too small to play a role in constraining the deformation texture during recrystallization behavior, so it cannot play a role in improving workability. If it is more than 5 μm, there is a problem that causes surface defects such as scab.

In addition, even when the distribution density of the Al—Ca—Ti—Mg—O-based oxide is less than 9/mm2, the role of constraining the deformation texture during recrystallization behavior is insufficient, so there is a problem that the present disclosure does not realize the desired recrystallized texture characteristics.

Next, a manufacturing method of a ferritic stainless steel with improved expandability according to another aspect of the present disclosure will be described.

A manufacturing method of a ferritic stainless steel with improved expandability according to an embodiment of the present disclosure includes: hot rolling the slab including, in percent (%) by weight of the entire composition, Cr: 10 to 25%, N: 0.015% or less (excluding 0), Al: 0.005 to 0.04%, Nb: 0.1 to 0.6%, Ti: 0.1 to 0.5%, the remainder of iron (Fe) and other inevitable impurities; cold rolling the hot rolled material; and cold rolling annealing the cold rolled material.

The reason for the numerical limitation of the alloying element content is as described above.

After the hot rolling and hot rolling annealing of the stainless steel containing the above composition, cold rolling and cold rolling annealing may be performed to form a final product.

In order to develop different characteristics of the texture of the surface layer portion and the center portion in the thickness direction, the roll diameter must be small during cold rolling. This is because the smaller the roll diameter, the greater the difference in the deformation mode (surface layer portion shear deformation, center portion plane deformation) of the surface layer portion and the center portion, and the deformation texture is also significantly different. Specifically, the smaller the roll diameter, the higher the cube-fiber fraction at the surface layer portion.

In this way, when the final cold rolled annealing material is manufactured through cold rolling and cold rolling annealing by controlling the roll diameter during cold rolling together with the alloy component and inclusion conditions, the characteristics of the required texture of the surface layer portion and the center portion in the thickness direction can be developed differently to maximize the texture sandwich effect. The cold rolling may be performed under roll diameter conditions of 100 mm or less.

The cold rolled annealing material thus produced satisfies the following equation (1).

$$Z=X*Y\geq 17 \quad \text{equation (1)}$$

Here, based on the thickness T of ferritic stainless steel, X means [(111)//ND texture fraction]/[(100)//ND texture fraction] of the region from T/3 to 2T/3, and Y means 10*[(100)//ND texture fraction]/[(111)//ND texture fraction] of the region from the surface layer to T/3.

Hereinafter, it will be described in more detail through a preferred embodiment of the present disclosure.

EXAMPLE

An experiment was conducted to produce the final product according to the production conditions of commercially produced ferritic stainless steel, and a hot rolled annealing steel sheet was prepared by hot rolling annealing the hot rolled sheet from the continuously cast slab by using the molten steel produced while changing the content of each component as shown in Table 1.

Thereafter, cold rolling was performed by varying the cold rolling roll diameter, and cold rolling annealing treatment was performed to produce cold rolled annealing steel sheets having a thickness of 0.5 to 3 mm.

TABLE 1

| | Cr | N | Al | Nb | Ti | Ca | Mg |
|---|---|---|---|---|---|---|---|
| Inventive steel 1 | 18.3 | 0.009 | 0.007 | 0.33 | 0.21 | 0.0008 | 0.0005 |
| Inventive steel 2 | 17.2 | 0.008 | 0.021 | 0.43 | 0.18 | 0.0009 | 0.0006 |
| Inventive steel 3 | 18.9 | 0.009 | 0.034 | 0.38 | 0.28 | 0.0007 | 0.0004 |
| Comparative steel 1 | 16.5 | 0.007 | 0.009 | 0.47 | 0.22 | 0.0010 | 0.0008 |
| Comparative steel 2 | 19.3 | 0.008 | 0.021 | 0.26 | 0.26 | 0.0014 | 0.0009 |
| Comparative steel 3 | 17.5 | 0.009 | 0.015 | 0.32 | 0.14 | 0.0007 | 0.0007 |
| Comparative steel 4 | 18.2 | 0.010 | 0.038 | 0.45 | 0.35 | 0.0005 | 0.0008 |

The inventive steel and comparative steel according to Table 1 were used in the experiment.

For the transverse direction cross section of the final cold rolled annealing material, the texture fraction was measured using Electron Backscatter Diffraction (EBSD), and the texture parameters for each thickness position were calculated and shown in Table 2 below.

In addition, the distribution density of the effective oxide was measured with a scanning electron microscope (SEM) for the transverse direction cross section of the final cold rolled annealing material. Table 3 shows roll diameter during cold rolling, HER value, thickness and whether cracks occur during pipe expansion of the real parts.

TABLE 2

| | Center | | Surface | | | | |
|---|---|---|---|---|---|---|---|
| | 111//ND | 100//ND | 111//ND | 100//ND | X | Y | Z |
| Inventive Example 1 | 36.9% | 8.4% | 23.8% | 10.0% | 4.4 | 4.2 | 18.5 |
| Inventive Example 2 | 35.1% | 6.9% | 27.4% | 10.7% | 5.1 | 3.9 | 19.9 |
| Inventive Example 3 | 46.2% | 7.3% | 38.2% | 14.8% | 6.3 | 3.9 | 24.5 |
| Comparative Example 1 | 28.2% | 10.8% | 19.8% | 10.4% | 2.6 | 5.3 | 13.7 |

TABLE 2-continued

| | Center | | Surface | | | | |
|---|---|---|---|---|---|---|---|
| | 111//ND | 100//ND | 111//ND | 100//ND | X | Y | Z |
| Comparative Example 2 | 27.5% | 9.5% | 18.7% | 10.6% | 2.9 | 5.7 | 16.4 |
| Comparative Example 3 | 37.9% | 6.8% | 32.0% | 8.3% | 5.6 | 2.6 | 14.5 |
| Comparative Example 4 | 36.4% | 7.5% | 33.2% | 8.5% | 4.9 | 2.6 | 12.4 |

TABLE 3

| | Effective oxide number/mm$^2$ | Rolling roll diameter (mm) | HER value | Crack | Thickness (mm) |
|---|---|---|---|---|---|
| Inventive Example 1 | 13 | 90 | 164.3 | X | 2.5 |
| Inventive Example 2 | 10 | 90 | 166.8 | X | 2 |
| Inventive Example 3 | 18 | 90 | 177 | X | 1.2 |
| Comparative Example 1 | 8 | 150 | 143.3 | ○ | 2.5 |
| Comparative Example 2 | 14 | 300 | 154.6 | ○ | 2 |
| Comparative Example 3 | 7 | 150 | 140.2 | ○ | 1.2 |
| Comparative Example 4 | 6 | 300 | 135.3 | ○ | 2 |

FIG. 4 is a graph showing texture parameters according to disclosed Inventive Example 2 and Comparative Example 3.

As described above, the texture capable of securing workability in the plane deformation condition occurring in the center portion is gamma-fiber, and the texture capable of securing workability in other deformation behavior conditions other than the plane deformation occurring in the surface layer portion is a cube-fiber. Therefore, in order to maximize the texture sandwich effect of the final cold-rolled annealed steel sheet, the recrystallized texture characteristics of the surface layer portion and the center portion must be different.

In the case of the above embodiments, compared to the comparative examples, the fraction of the cube-fiber texture compared to the gamma-fiber is higher in the surface layer portion, and the fraction of the gamma-fiber texture than the cube-fiber in the center portion is higher, so it can be confirmed that the texture parameter Z value is 17 or more.

In contrast, in Comparative Example 1 and Comparative Example 2, the fraction of gamma-fiber texture of the center portion compared to the cube-fiber was low, and the Z value was less than 17.

In addition, in Comparative Examples 3 and 4, the fraction of the cube-fiber texture compared to the gamma-fiber of the surface layer portion was low, and the Z value was less than 17.

Specifically, referring to Tables 2 and 3, in Comparative Example 1, when cold rolling, the roll diameter was as large as 150 mm, and the distribution density of effective oxide was measured to be 8/mm$^2$, so that the texture parameter Z of the final cold rolled annealing material was 13.7, which did not reach 17, and thus cracks occurred during pipe expansion of the real parts.

Referring to Table 2 and Table 3, in the case of Comparative Example 2, the distribution density of the effective oxide is satisfactory, but when cold rolling, the roll diameter is 300 mm, so the texture parameter Z of the final cold rolled annealing material is 16.4, which does not reach 17. As a result, cracks occurred during pipe expansion of the real parts.

Referring to Table 2, Table 3, and FIG. 4, in Comparative Example 3, the roll diameter during cold rolling was as large as 150 mm, and the distribution density of effective oxide was measured to be 7/mm$^2$, so that the texture parameter Z of the final cold rolled annealing material was 14.5, which does not reach 17. As a result, cracks occurred during pipe expansion of the real parts.

Referring to Table 2 and Table 3, in Comparative Example 4, the roll diameter during cold rolling was as large as 300 mm, and the distribution density of effective oxide was measured to be 6/mm$^2$, so that the texture parameter Z of the final cold rolled annealing material was 12.4, which does not reach 17. As a result, cracks occurred during pipe expansion of the real parts.

The ferritic stainless steel manufactured according to an embodiment of the present disclosure can increase the expandability and minimize the occurrence of cracks by maximizing the HER value of the final cold rolled annealing material to 160 or more by controlling the texture conditions for each thickness position.

While the present disclosure has been particularly described with reference to exemplary embodiments, it should be understood by those of skilled in the art that various changes in form and details may be made without departing from the spirit and scope of the present disclosure.

Industrial Applicability

The ferritic stainless steel according to the present disclosure has improved expandability and can be used as a part of automotive exhaust systems.

The invention claimed is:

1. A ferritic stainless steel, the ferritic stainless steel comprising, in percent (%) by weight of an entire composition, Cr: 10 to 25%, N: more than 0% and 0.015% or less, Al: 0.005 to 0.04%, Nb: 0.33 to 0.6%, Ti: 0.1 to 0.5%, Ca: 0.0004 to 0.002% and Mg: 0.0002 to 0.001%, a remainder of iron (Fe) and other inevitable impurities, and satisfying the following equation (1)

$$Z=X*Y\geq 17 \quad \text{equation(1)}$$

wherein, based on a thickness (T) of ferritic stainless steel, X means [(111)//ND texture fraction]/[(100)//ND texture fraction] of a region from T/3 to 2T/3, and Y means 10*[(100)//ND texture fraction]/[(111)//ND texture fraction] of a region from a surface layer to T/3, wherein the ferritic stainless steel comprises Al—Ca—Ti—Mg—O oxide having a maximum diameter of 0.05 to 5 mm and a distribution density of 9/mm$^2$ or more, wherein the Al—Ca—Ti—Mg—O oxide includes $TiO_2$, CaO, $Al_2O_3$ and MgO, and wherein a (111)//ND texture fraction in a center portion of the cold-rolled annealed ferritic stainless steel sheet is 70% or less, a (100)//ND texture fraction is 2% or more, the (100)//ND texture fraction in a surface layer portion is 30% or less, and the (111)//ND texture fraction is 10% or more.

2. The ferritic stainless steel of claim 1, wherein the ferritic stainless steel satisfies the following equation (2)

$$(D_f-D_0)/D_0*100\geq 160 \quad \text{equation (2)}$$

wherein, $D_f$ means a hole length of a machining portion after molding, and $D_0$ means a length of an initial machining hole.

3. The ferritic stainless steel of claim 1, wherein the thickness is 0.5 to 3 mm.

4. A manufacturing method of the ferritic stainless steel according to claim 1, the manufacturing method comprising:

hot rolling the slab comprising, in percent (%) by weight of the entire composition, Cr: 10 to 25%, N: more than 0% and 0.015% or less, Al: 0.005 to 0.04%, Nb: 0.33 to 0.6%, Ti: 0.1 to 0.5%, Ca: 0.0004 to 0.002% and Mg: 0.0002 to 0.001%, the remainder of iron (Fe) and other inevitable impurities;

cold rolling the hot rolled material; and cold rolling annealing the cold rolled material, and wherein the cold rolled annealing material satisfies the following equation (1)

$$Z=X*Y\geq 17 \quad \text{equation(1)}$$

wherein, based on the thickness T of ferritic stainless steel, X means [(111)//ND texture fraction]/[(100)//ND texture fraction] of the region from T/3 to 2T/3, and Y means 10*[(100)//ND texture fraction]/[(111)//ND texture fraction] of the region from the surface layer to T/3, i. wherein the ferritic stainless steel comprises Al—Ca—Ti—Mg—O oxide having a maximum diameter of 0.05 to 5 mm and a distribution density of 9/mm$^2$ or more ii. wherein the Al—Ca—Ti—Mg—O oxide includes $TiO_2$, CaO, $Al_2O_3$ and MgO, and iii. wherein a (111)//ND texture fraction in a center portion of the cold-rolled annealed ferritic stainless steel sheet is 70% or less, a (100)//ND texture fraction is 2% or more, the (100)//ND texture fraction in a surface layer portion is 30% or less, and the (111)//ND texture fraction is 10% or more.

5. The manufacturing method of claim 4, wherein the manufacturing method controls the roll diameter of the cold rolling to 100 mm or less.

* * * * *